United States Patent [19]

Chuang

[11] Patent Number: 4,946,088

[45] Date of Patent: Aug. 7, 1990

[54] BUSHING FORMING MACHINE

[76] Inventor: Shyue S. Chuang, No. 10, Ta Yu 3r St., Ta Liao Shiang, Kaohsiung Hsien, Taiwan

[21] Appl. No.: 380,139

[22] Filed: Jul. 14, 1989

[51] Int. Cl.[5] ..... B23K 11/10; B23K 11/32

[52] U.S. Cl. ..... 228/18; 228/13; 228/44.3; 228/47; 29/779; 29/786; 29/787; 29/898.056; 219/78.15; 219/78.16; 219/80

[58] Field of Search ..... 228/13, 17, 18, 44.3, 228/47, 173.5, 173.7; 29/148.4 S, 779, 786, 787; 219/78.15, 78.16, 80, 86.1

[56] References Cited

U.S. PATENT DOCUMENTS

| | | | |
|---|---|---|---|
| 3,412,450 | 11/1968 | Whiteman et al. | 29/779 |
| 3,789,480 | 2/1974 | Iyengar et al. | 29/779 |
| 3,898,416 | 8/1975 | Shotting et al. | 219/80 |
| 4,078,287 | 3/1978 | Kupchick | 29/148.4 S |

*Primary Examiner*—Richard K. Seidel

*Assistant Examiner*—Samuel M. Heinrich

*Attorney, Agent, or Firm*—Dellett, Smith-Hill and Bedell

[57] ABSTRACT

A bushing forming machine including:

a metal strip delivery system including a metal strip wound on a drum; a forming mill for forming the metal strip to a shape; a first conveyer carrying the metal strip to the forming mill; and a punch provided on a passage of the metal strip for cutting the metal strip to a length;

a filler delivery system including a filler wound on a drum; a cutter for cutting the filler to a length; a second conveyer carrying the filler to the cutter; a gripper feeder holding and feeding the filler after cut by the cutter;

a mold rotatably receiving and driving the metal strip and the filler;

a pair of compression rollers being actuated to compress the metal strip and the filler wound on the mold; the a welder radially provided beside the mold for welding the metal strip.

10 Claims, 5 Drawing Sheets

BUSHING FORMING MACHINE

FIELD OF THE INVENTION

The present invention relates to a forming machine, and more particularly to a bushing forming machine.

BACKGROUND OF THE INVENTION

Bushings are widely used in chemical industry. The bushings are provided around chemical supply pipes between every two connecting ones for preventing leakage of the chemical products. The bushing is generally a ring having a metal strip of several loops with a strip shaped filler, such as asbestos, overlapped therebetween.

A conventional bushing forming machine is shown in FIG. 7. The bushing forming machine is intended for machining coiled stock, i.e., a metal strip M which is wound to form a spool S. The metal strip M is sent to a mold D through a pair of forming rollers R of a forming mill F. An opening O is formed in the mold D. A pneumatically operated roller P is engagable with the mold D. A free end of the metal strip M is inserted into the opening O of the mold D so that the metal strip M can be wound on the mold D by means of a foot pedal (not shown). Pressing the foot pedal one time, makes the mold D rotate one revolution. After the metal strip M is wound on the mold D for one revolution, a welder W makes a spot weld on the metal strip M for forming a rigid ring. Then, a filler (not shown) is fed into the metal strip M when the mold D continues rotating. The thickness of the bushing can be determined by the number of the rotations of the metal strip M. The filler is cut before the metal strip M rotates one more round. The welder W makes another spot weld on the metal strip M so as to form a ring-shaped bushing. The bushing is knocked down from the mold D by a plastic hammer so that a bushing is completed.

This type of forming machine requires a lot of man power, e.g., to insert the metal strip M into the opening O, to weld, to fill the filler, to cut and to knock down the bushing, etc. Therefore, a skillful operator is strongly required. The quality of the bushing can not be maintained at a certain level. The unit cost of the bushing is increased. In addition, the manually welding process is dangerous.

The present invention has arisen to mitigate and/or obviate the afore-described disadvantages of the conventional bushing forming machine.

SUMMARY OF THE INVENTION

The primary object of the present invention is to provide a bushing forming machine which forms bushings automatically without any man power.

Another object of the present invention is to provide a bushing forming machine which produces bushings very fast and maintains quality at a certain level.

The present invention seeks to provide a bushing forming machine including a metal strip delivery system. The metal strip delivery system includes a drum for winding a metal strip to form a spool; a forming mill for forming the metal strip to a shape; a first conveyer carrying the metal strip to the forming mill; and a punch provided on a passage of the metal strip after the forming mill for cutting the metal strip to a predetermined length. A filler delivery system includes a filler wound on a drum to form a spool; a cutter for cutting the filler to a length; a second conveyer carrying the filler to the cutter; a gripper feeder holding and feeding a filler after cut by the cutter. A mold rotatably receives and drives the metal strip and the filler. A pair of compression rollers are actuated to compress the metal strip and the filler wound on the mold. A welder is radially provided beside the mold for welding the metal strip.

Further objects and advantages of the present invention will become apparent from a careful reading of the detailed description provided herein below, with appropriate reference to the accompanying drawings.

DETAILED DESCRIPTION OF THE INVENTION

Figure 1:
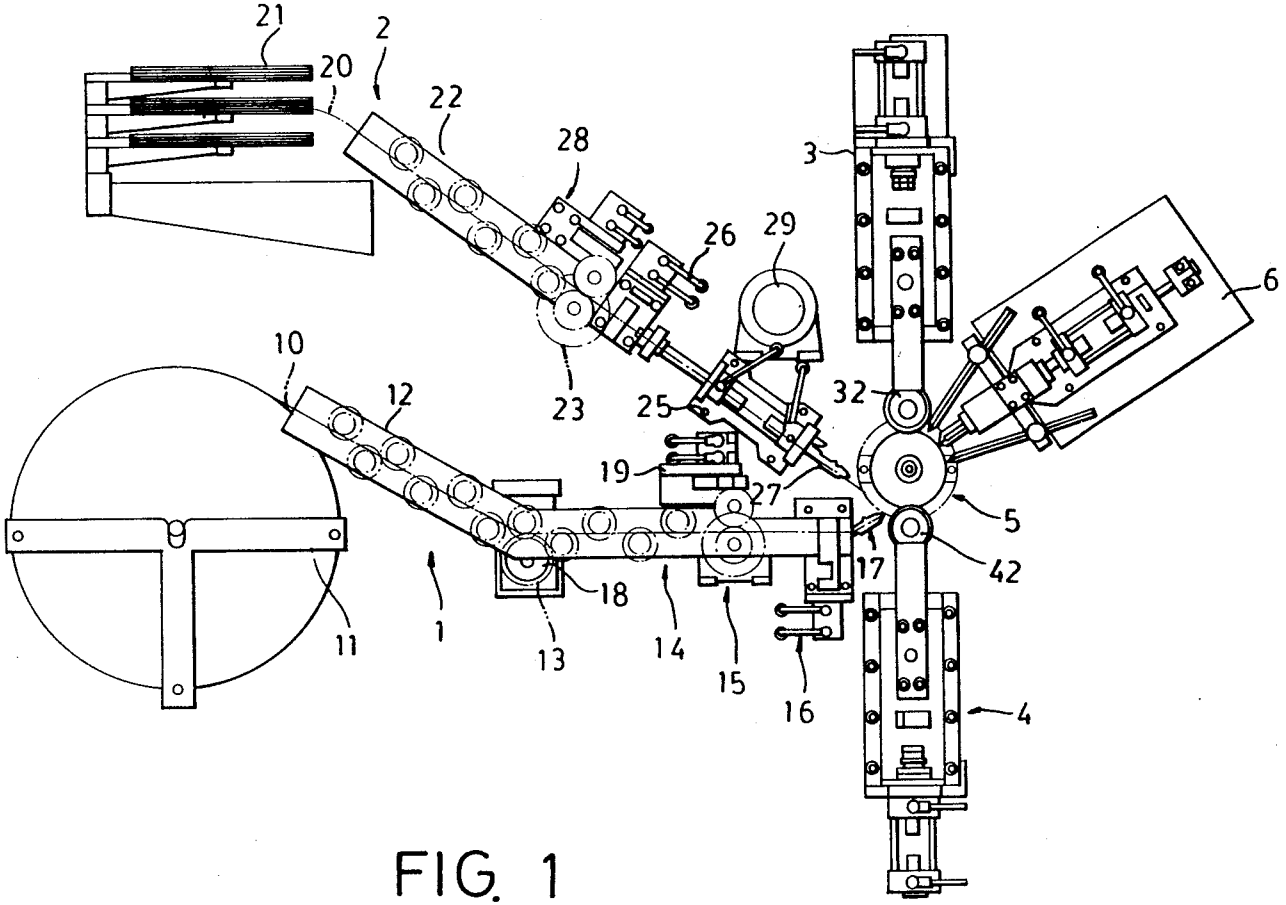
FIG. 1 is a schematic view of a bushing forming machine in accordance with the present invention.
Figure 2:
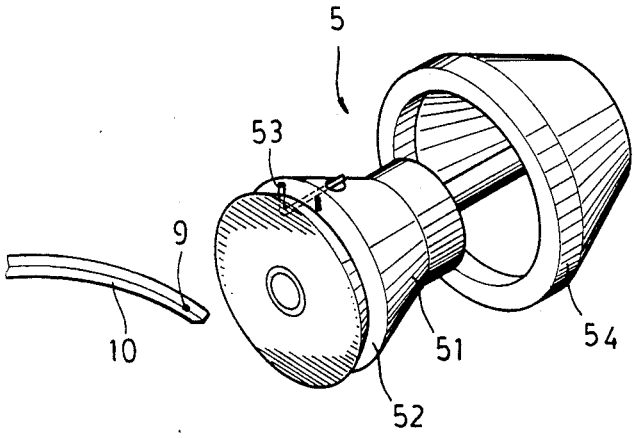
FIG. 2 is a perspective view of the mold of the bushing forming machine.

Referring to the drawings and initially to FIGS. 1 and 2, the bushing forming machine in accordance with the present invention comprises generally a metal strip delivery system 1, a filler delivery system 2, a pair of actuators 3, 4, a mold 5 and a welder 6.

The metal strip delivery system 1 includes a drum 11 suitable for winding a metal strip 10 to form a spool. The cross section of the metal strip 10 is substantially a slender rectangle. A roller type conveyer 12 delivers the metal strip 10 to a forming mill 13. A forming roll 18 of the forming mill 13 compresses the metal strip 10 to form a predetermined shape, which is generally V-shaped. A straightening device 14 delivers the metal strip 10 to a punch 16 for cutting the metal strip 10 and punching a hole 9 at a front end of the following metal strip 10 (FIG. 2). Then, the metal strip 10 is sent to the mold 5 by a feeding guide 17. The punch 16 is intermittently actuated at suitable time intervals. If necessary, a pair of compression rollers 15 which are actuated by a pneumatic actuator 19 are further provided for holding the metal strip 10 when the punch 16 is actuated.

The filler delivery system 2 includes a drum 21 suitable for winding a strip shaped filler 20 which is generally made of asbestos. The cross section of the filler 20 is similar to that of the metal strip 10. A roller type conveyer 22 delivers the filler 20 to a cutter 26. If necessary, a pair of compression rollers 23 which are actuated by a pneumatic actuator 28 are further provided for holding the filler 20 when the filler 20 is cut by the cutter 26. A gripper feeder 25, which is actuated by a pneumatic actuator 29, sends the filler 20 into the mold 5 through a feeding guide 27.

Figure 3:
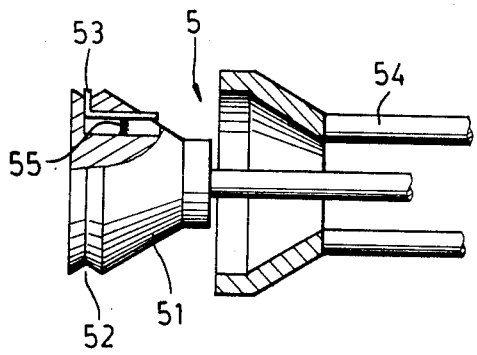
FIG. 3 is a cross sectional view of the mold of FIG. 2, taken along line III—III, in which two main parts of the mold are separated.
Figure 4:
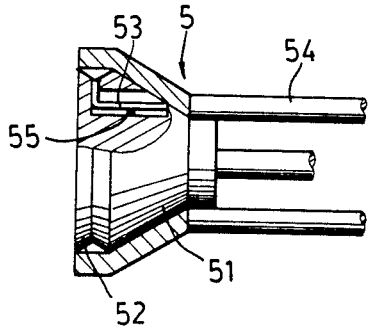
FIG. 4 is a cross sectional view similar to FIG. 3, in which the two main parts of the mold are engaged.

Referring next to FIGS. 2, 3, and 4, the mold 5 includes a male frustum 51 and a female frustum 54 engagable with each other. The male frustum 51 is rotatable. An annular groove 52 whose shape corresponds to a required shape of the metal strip 10, generally V-shaped, is formed at a front end of the male frustum 51 on a peripheral surface thereof. An L-shaped retainer pin 53 is embedded in the male frustum 51 with one leg extending out from the middle of the annular groove 52 and the other end extending out from the tapered surface of the male frustum 51. A spring member 55 is in conjunction with the retainer pin 53 for resiliently retaining the retainer pin 53 so that the retainer pin 53 can be fully embedded in the male frustum 51 by the engagement of the male and female frustums (FIG. 4). Normally, the male frustum 51 is stationary, and the female frustum 54 is longitudinally slidable from the position as shown in FIG. 3 to the position as shown in FIG. 4. The hole 9 of the metal strip 10 is engaged on the retainer pin 53 so that the metal strip 10 can be drawn rotatively by the rotation of the male frustum 51. More retainer pins 53 and spring members 55 (not shown) can be provided around the male frustum 51 so that the hole 9 of the metal strip 10 can be engaged with any of the retainer pins 53.

Figure 5:
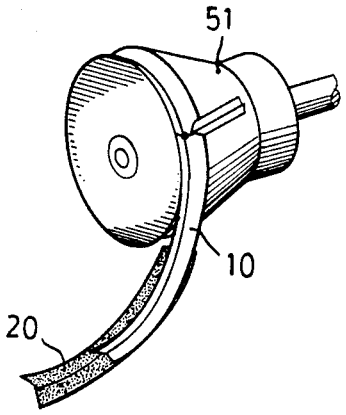
FIG. 5 is a perspective view of the mold illustrating the formation of the bushing.
Figure 6:
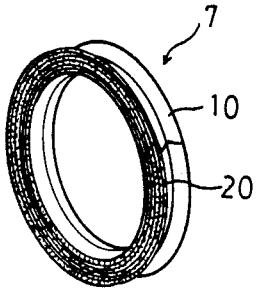
FIG. 6 is a perspective view of a completed bushing.
Figure 7:
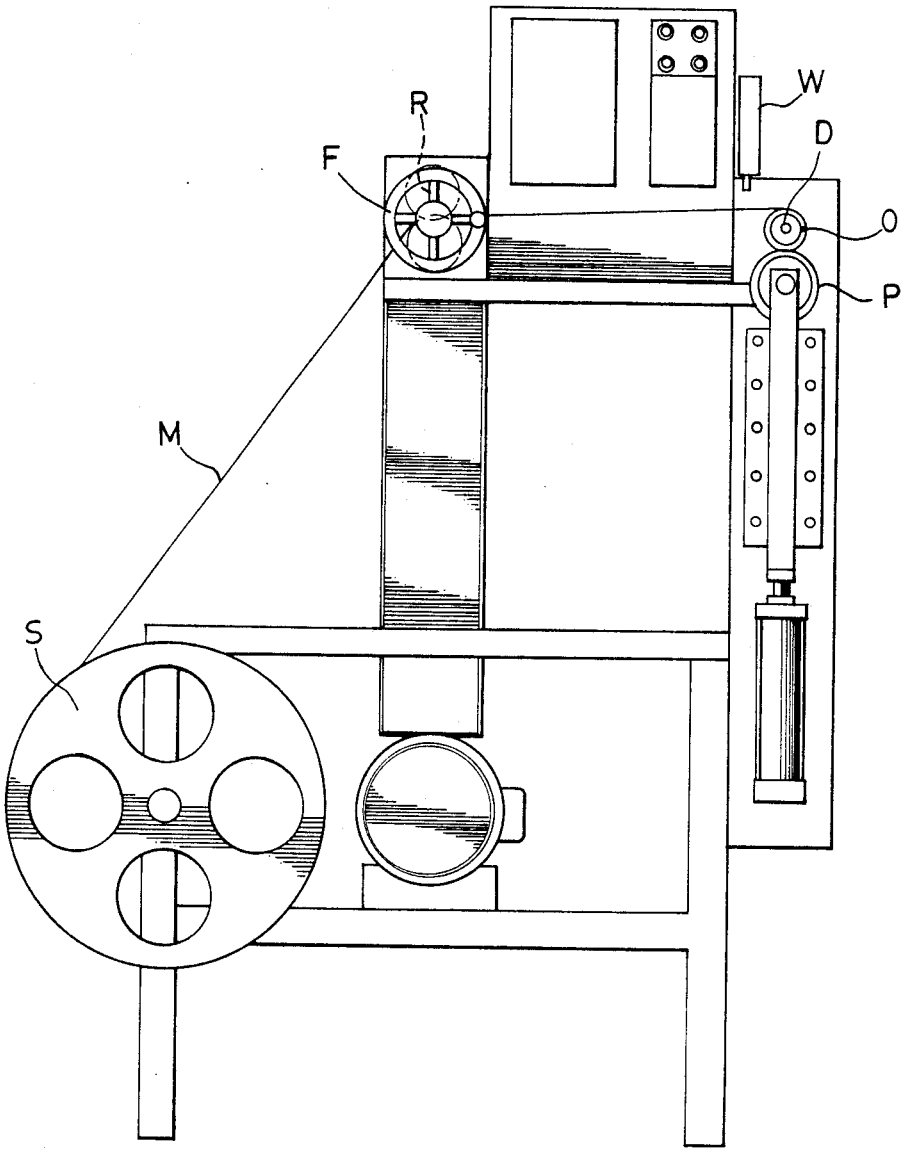
FIG. 7 PRIOR ART
FIG. 7 is a schematic plane view showing a conventional bushing forming machine.

Referring again to FIG. 1, when the male frustum 51 begins winding the metal strip 10, the rollers 32, 42 respectively provided on the ends of the actuators 3, 4 are actuated by the actuators 3, 4 to contact and press the metal strip 10 wound on the annular groove 52 of the male frustum 51 of the mold 5. The shapes of the outer peripheral surfaces of the rollers 32, 42 correspond to the shape of the annular groove 52. The actuators 3, 4 can be either pneumatic or hydraulic actuators. After the metal strip 10 is drawn by the male frustum 51 for one revolution, the welder 6, which is radially provided around the mold, makes a spot weld on the metal strip 10 in order to connect the free end of the metal strip 10 (FIG. 5); therefore, a rigid ring is formed. At this time, the filler 20 is fed into the metal strip 10 and rotated with the metal strip 10. The number of the revolutions of the metal strip 10 or the thickness of the bushing 7 (FIG. 6) is predetermined. Generally, the length of the filler 20 is shorter than the length of the metal strip 10 for two to three revolutions. The metal strip 10 and the filler 20 are respectively cut to predetermined lengths so that the metal strip 10 rotates at least one more round than the filler 20 before the metal strip 10 of a bushing is finally welded by the welder 6. The welder 6 makes another spot weld at the rear end of the metal strip 10 of the machining bushing after cut by the punch 16. Thus, a bushing 7 is completed (FIG. 6).

Accordingly, the present invention has the following advantages:

(a) The bushing is made automatically without any man power. Therefore, no skillful operators are required.

(b) The bushing is made very fast and the quality thereof is maintained at a certain level. Therefore, the productivity is increased greatly, and the cost is lowered remarkably.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bushing forming machine comprising:

a metal strip delivery system including:

a metal strip wound on a drum to form a spool;

a forming mill for forming said metal strip to a predetermined shape;

a first conveyer being provided for carrying said metal strip to said forming mill; and a punch provided on a passage of said metal strip after said forming mill for cutting said metal strip to a predetermined length;

a filler delivery system including:

a filler wound on a drum to form a spool;

a cutter for cutting said filler to a predetermined length;

a second conveyer being provided for carrying said filler to said cutter; and a gripper feeder being provided for holding and feeding a cut filler;

a mold rotatably receiving and driving said metal strip and said filler;

a first pair of compression rollers being actuated to compress said metal strip and said filler wound on said mold; and a welder being provided radially beside said mold for welding said metal strip.

2. A forming machine as set forth in claim 1, wherein a straightening device is further provided between said forming mill nd said punch for straightening said metal strip.

3. A forming machine as set forth in claim 2, wherein a second pair of compression rollers are further provided between said straightening device and said punch for holding said metal strip when said punch is operating.

4. A forming machine as set forth in claim 1, wherein said mold comprises a male frustum and a female frustum engagable with each other; an annular groove being provided at a front end of said male frustum around a peripheral surface thereof; and a retainer pin being resiliently provided in said male frustum with one leg protruding out from said annular groove, and the other leg protruding out from a tapered surface of said male frustum; a hole is formed at a front end of said metal strip by said punch so as to engage said retainer pin of said mold.

5. A forming machine as set forth in claim 4, wherein said retainer pin is L-shaped.

6. A forming machine as set forth in claim 1, wherein a third pair of compression rollers are provided between said second conveyer and said cutter for holding said filler when said cutter is operating.

7. A forming machine as set forth in claim 4, wherein a peripheral shape of each of said first compression rollers corresponds to a shape of said annular groove of said male frustum.

8. A forming machine as set forth in claim 1, wherein said welder is a spot welder which makes a spot weld for a first revolution of said metal strip wound on said mold, and makes another spot weld for a last revolution of said metal strip after cut by said punch.

9. A forming machine as set forth in claim 1, wherein a length of said filler cut by said cutter is shorter than a length of said metal strip cut by said punch for 2 to 3 revolutions.

10. A forming machine as set forth in claim 1, wherein a first feeding guide is provided between said punch and said mold for guiding said metal strip into said mold; and a second feeding guide is provided between said gripper feeder and said mold for guiding said filler into said mold.

* * * * *